US009810100B2

(12) United States Patent
Bastier et al.

(10) Patent No.: US 9,810,100 B2
(45) Date of Patent: Nov. 7, 2017

(54) BARRING GEAR ASSEMBLY FOR DRIVING IN ROTATION A SHAFT OF A TURBO-ALTERNATOR GROUP

(71) Applicant: ALSTOM Technology Ltd, Baden (CH)

(72) Inventors: Arnaud Bastier, Bourg la Reine (FR); Jacques Mizera, Pierrefonds (FR)

(73) Assignee: General Electric Technology GmbH, Baden (CH)

( * ) Notice: Subject to any disclaimer, the term of this patent is extended or adjusted under 35 U.S.C. 154(b) by 872 days.

(21) Appl. No.: 13/875,460

(22) Filed: May 2, 2013

(65) Prior Publication Data

US 2013/0243579 A1 Sep. 19, 2013

Related U.S. Application Data

(63) Continuation of application No. PCT/EP2011/069140, filed on Oct. 31, 2011.

(30) Foreign Application Priority Data

Nov. 5, 2010 (FR) ..... 10 59175

(51) Int. Cl.
*F01D 25/34* (2006.01)
*F01D 25/36* (2006.01)

(52) U.S. Cl.
CPC ..... *F01D 25/34* (2013.01); *F01D 25/36* (2013.01); *F05D 2220/31* (2013.01); *F05D 2260/4031* (2013.01)

(58) Field of Classification Search
CPC ..... F01D 25/34; F01D 25/36
See application file for complete search history.

(56) References Cited

U.S. PATENT DOCUMENTS

| | | | | |
|---|---|---|---|---|
| 3,485,041 | A * | 12/1969 | Evans | F01D 25/34 192/104 R |
| 3,919,894 | A | 11/1975 | Keeter et al. | |
| 4,211,070 | A | 7/1980 | Portmann | |
| 4,507,926 | A | 4/1985 | Teckentrup et al. | |
| 5,056,989 | A | 10/1991 | Turner et al. | |
| 5,088,341 | A * | 2/1992 | Hyde | F01D 25/36 290/48 |

(Continued)

FOREIGN PATENT DOCUMENTS

| | | | |
|---|---|---|---|
| CN | 101144510 | A | 3/2008 |
| CN | 201588661 | U | 9/2010 |
| CN | 202081924 | U | 12/2011 |

(Continued)

*Primary Examiner* — Justin Seabe
(74) *Attorney, Agent, or Firm* — GE Global Patent Operation; Cynthia W. Flanigan

(57) ABSTRACT

The barring gear assembly is designed to drive in rotation a shaft of a turbo-alternator group having an axis of rotation A. The barring gear assembly includes a main wheel fixed on said shaft and defining lateral sides located on either side of the axis of rotation A, a barring gear module having a support piece on which is mounted a clutch system for coupling and uncoupling a secondary shaft to and from the main wheel, the secondary shaft being driven by an auxiliary motor, and the barring gear module being positioned on one of said lateral sides (C1) of the axis of rotation A.

14 Claims, 4 Drawing Sheets

(56) References Cited

U.S. PATENT DOCUMENTS 7,309,208 B2 * 12/2007 Hansen ..... F01D 25/36
415/123

FOREIGN PATENT DOCUMENTS

| | | | |
|---|---|---|---|
| DE | 524329 | | 5/1931 |
| DE | 2422011 | | 11/1975 |
| FR | 1059175 | A | 3/1954 |
| GB | 1024895 | A | 4/1966 |

* cited by examiner

BARRING GEAR ASSEMBLY FOR DRIVING IN ROTATION A SHAFT OF A TURBO-ALTERNATOR GROUP

TECHNICAL FIELD

The present invention relates to the field of turbo-alternator groups. It focuses in particular on steam turbines but could be applied to gas turbines. Such turbines are used in power plants, each turbine driving a generator producing electricity. This can be a plant operating on fossil or non-conventional energy.

More particularly, the invention relates to a barring gear assembly for driving in rotation a shaft comprising rotors of each module of the turbine as well as that of the generator. Rotation occurs by means of an auxiliary motor capable of overcoming the resistant couple of the shaft. The periods of turning take place during phases preceding or following periods of electricity production of the turbo-alternator group. Rotation of the shaft during startup and stopping periods of the group is necessary in light of homogenising the temperatures of the rotor and thus avoiding any flexion of the shaft under the effect of thermal dissymmetry. The barring gear assembly also initiates rotation of the shaft during a startup phase prior to injection of steam in the steam turbine. The rotation speed of the shaft during turning phases is low and constant. It varies from a few revolutions per minute to a few tens of revolutions per minute according to the turbo-alternator groups.

BACKGROUND ART

According to a prior art barring gear assembly, the turning function is executed by an electric motor driving a first gear by means of a hydraulic coupler. This initial reduction is obtained through a pinion mounted on the shaft motor and a guided wheel fixed on a secondary shaft. The secondary shaft is connected to the shaft via a second gear whereof one wheel is fixed to a clutch. The clutch disconnects the barring gear assembly from the shaft. All the components are lodged into a box, except the electric motor and the hydraulic coupler. Such an arrangement has a certain number of disadvantages:

- the presence of the clutch on the shaft makes maintenance operations of the barring gear assembly highly complex. Disassembling the barring gear assembly requires disassembling of the components located between this clutch and the closest end of the shaft. This especially implies long and complex adjustment operations as each component is reassembled. In particular, the presence of the clutch on the shaft disallows positioning of the barring gear assembly between two rotors of the shaft.
- the flexible coupling between the hydraulic coupler and the endless screw placed inside the box are subjected to the atmosphere caused by oil projections and oil vapour. Its shelf life is thus seriously shortened.
- accessibility to the clutch is very difficult,
- the arrangement is not optimal. The presence of the clutch on the shaft necessarily extends said shaft. The general bulk of the turbo-alternator group is thus increased.

SUMMARY OF INVENTION

The object of the present invention is to rectify these disadvantages by improving accessibility, making maintenance easy, reducing bulk and simplifying equipment.

The invention relates to a barring gear assembly and a turbo-alternator group such as defined in the claims.

The barring gear assembly according to the invention is designed to drive in rotation a shaft of a turbo-alternator group having an axis of rotation (A). The barring gear assembly comprises a main wheel fixed on the shaft and having lateral sides located on either side of the axis of rotation , a barring gear module having a support piece on which is mounted a clutch system for coupling and uncoupling a secondary shaft to and from the main wheel. The secondary shaft is driven by an auxiliary motor. The barring gear module is positioned on one of said lateral sides of the axis of rotation. Such an arrangement of components is simplified and the assembly is more compact. In particular, the axial bulk of the shaft is reduced which in turn reduces the axial bulk of the machine shop and reduces the size of the concrete load-bearing structure of the turbo-alternator group. Interventions on the barring gear module are simplified as it is no longer necessary to intervene on the turbine shaft, but in retreat relative to the latter. Also, the barring gear module can be prepared outside the installation. Also, the invention makes it possible to place the barring gear assembly at any point on the shaft and not necessarily at an end of the shaft: as a consequence, the main wheel can be placed between two turbine rotors and the barring gear assembly can be arranged at that place.

According to another aspect, the clutch system is arranged at a level lower than that of the axis of rotation (A) of the turbine, which boosts rigidity and stability of the support of the barring gear assembly. Preferably, the secondary shaft is located below the parting line. The support is much more rigid as it is lower.

According to a preferred feature, the clutch system is mounted on the secondary shaft brought to rotation on said support piece. This characteristic enables modular construction of the barring gear with good stability. So, the secondary shaft does not turn in the disengaged position, in particular during periods of energy production. The secondary shaft turns only during turning phases when the motor revolves.

According to another particularly preferred feature, the clutch system comprises a pinion mounted displaceable along the secondary shaft, the displacement of the pinion enabling coupling and uncoupling of said motor to and from the main wheel via the secondary shaft. This feature makes visual control of the clutch easier. For example, in case of a problem on the clutch, initial visual control of the clutch is easy.

According to another preferred feature, the barring gear module comprises a gear reducer driving the secondary shaft, the gear reducer being mounted on said support piece. This feature gives appropriate reduction ratio and retains the modular construction of the barring gear.

According to another preferred feature, the gear reducer is a wheel gear reducer and endless screw whereof the wheel is mounted side by side with the clutch system. Such a construction completes the modular construction of the barring gear.

According to another preferred feature, the barring gear module is mounted in a box and an endless screw is extended by a shaft passing through the box. This characteristic takes the motor, the hydraulic coupler and the flexible coupling outside the box.

Preferably, the endless screw shaft passes through the box via a removable baffle. This installs and withdraws the barring gear module contiguously inside the box.

According to an embodiment, the endless screw shaft has an end located outside the box, the end being coupled to said motor via a hydraulic coupler and a flexible coupling. The flexible coupling outside the box is no longer subjected to the corrosive atmosphere inside the box.

Is also concerned a turbo-alternator group for producing electricity comprising at least one turbine module with a shaft driven by steam, the shaft being adapted for being driven by the barring gear assembly.

BRIEF DESCRIPTION OF THE DRAWINGS

The invention will be better understood from the following description given by way of example and in reference to the attached diagrams, in which.

DETAILED DESCRIPTION

Figure 1:
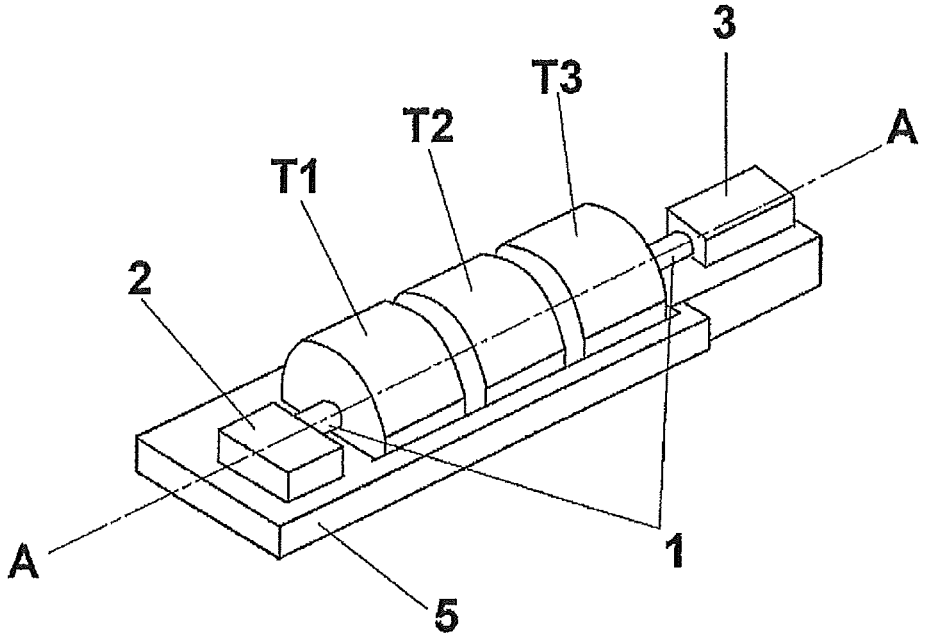
FIG. 1 illustrates in perspective a turbo-alternator group of electricity production according to the invention.

FIG. 1 illustrates a turbo-alternator group for producing electricity comprising an assembly of steam turbine modules, in this case three turbine modules T1, T2, T3, driving a steam generator 3. This turbo-alternator group rests on a rigid structural frame 5, generally made of concrete. In the present case, the power produced is between 500 MW and 2000 MW. The rotors of the modules of the steam turbine drive the generator 3 in rotation about the axis A. The generator is located to the rear of the turbo-alternator group. The shaft is extended to the front, at its end opposite the generator 3, as far as the barring gear assembly 2. By means of an auxiliary motor 4, the barring gear assembly 2 drives in rotation the shaft 1 via a clutch system 6 which connects or disconnects the shaft 1 to or from the motor 4. During electricity production, the turbine is disconnected from the motor. The motor 4 is preferably electric. According to the invention, the barring gear assembly can also be placed between two modules of the turbine (T1, T2, T3) or between the last module of the turbine (here T3) and the generator 3.

Figure 2:
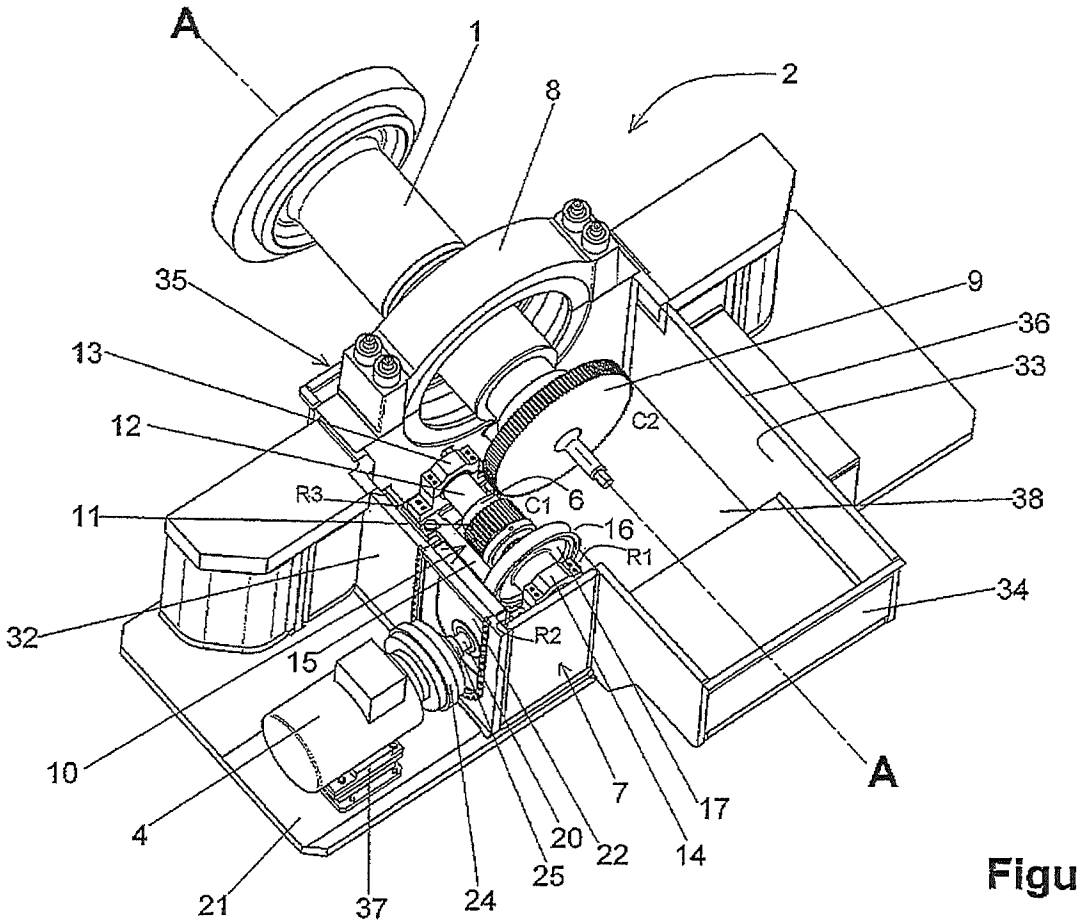
FIG. 2 illustrates the barring gear assembly according to the invention viewed in perspective from above.
Figure 3:
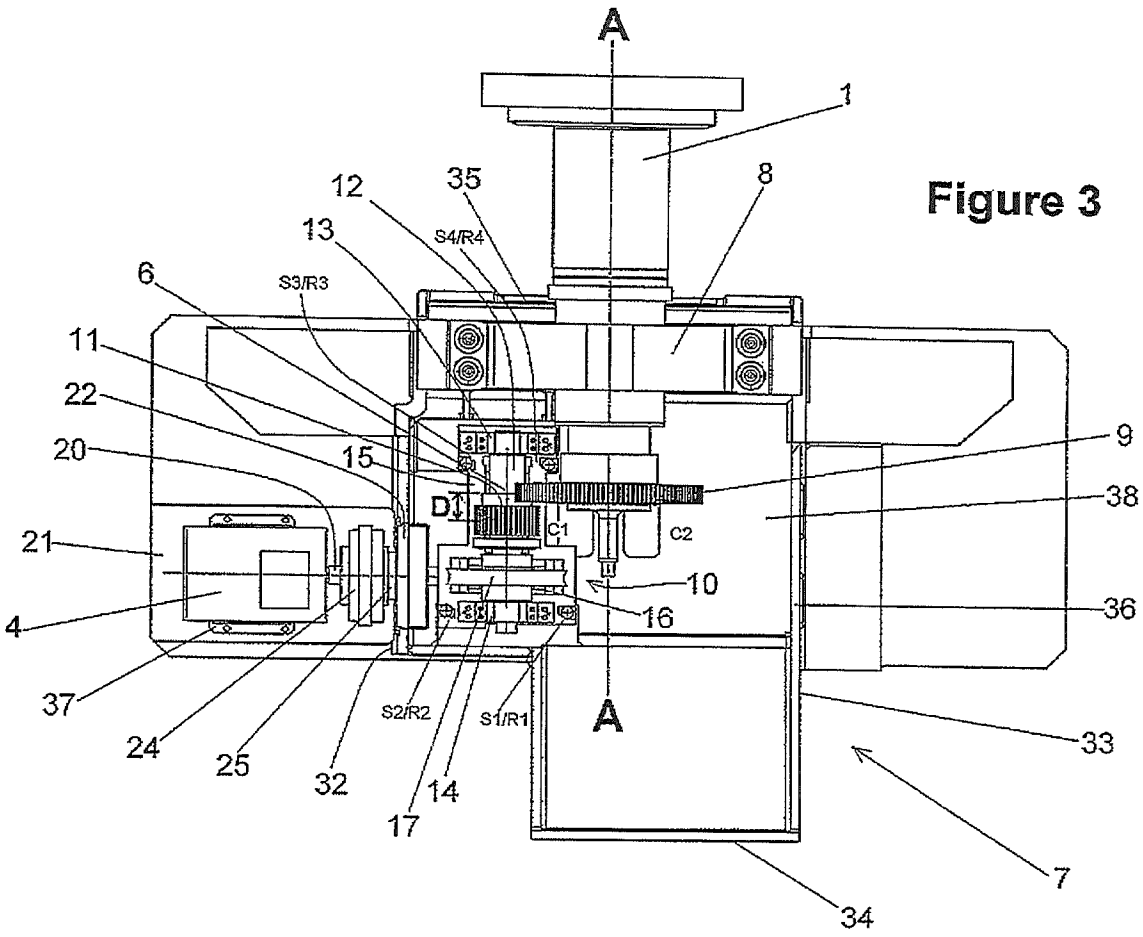
FIG. 3 illustrates the barring gear assembly according to the invention viewed from above.

FIGS. 2 and 3 illustrate more precisely a barring gear assembly 2. A barring gear module 10 is mounted inside a box 7 from which the cover (not illustrated) has been removed to show the inner mechanism. This cover is fixed to the box at the level of the parting line 36 of this box. The box 7 has a base 38 extending outside the box, on each side of the shaft. The box 7 has two lateral walls 32, 33 located on either side of the axis of turbine A, a rear wall 34 and a front wall 35. In operation, the box 7 is closed and sealed, closed by the cover. The box has a bearing 8 which receives the rotating end of the shaft 1. The bearing 8 is located against the front wall 35 of the box. A main cogged wheel 9 is fixed on the shaft 1, here at an end. Because of the characteristics of the invention, the wheel 9 can advantageously be fixed on the shaft in a place different to said above end: Preferably, the main wheel 9 could be arranged between two turbine modules or between the last turbine module and the generator. Situated on the peripheral side of said main wheel 9 is the barring gear module 10. More precisely, the main wheel 9 defines lateral sides C1, C2 located on either side of the axis of rotation A and the barring gear module 10 is positioned on one of the lateral sides, here C1, of the axis of rotation A.

The barring gear module 10 includes the clutch system 6 which comprises a cogged pinion 11 mounted on a secondary shaft 12. The pinion 11 can be moved along said secondary shaft 12 but is connected in rotation to the secondary shaft 12. FIGS. 2 and 3 show the pinion 11 disengaged from the main wheel 9 and the barring gear module 10 is then uncoupled from the shaft 1. Displacement D grips the pinion 11 on the main wheel 9, the barring gear module 10 then being coupled to the shaft of turbine 1. The dentures of the main wheel 9 and of the pinion 11 are straight dentures for easy engagement of the pinion on the wheel.

The secondary shaft 12 is mounted to rotate on two upper bearings 13, 14 located on either side of the pinion 11. The two upper bearings are mounted on the top of a support piece 15 which rests on receiving surfaces of the box 7. The secondary shaft 12 can be set in rotation by a wheel gear reducer 17 and endless screw 18 mounted on the support piece 15. The wheel of the gear reducer 17 is placed to the side of the pinion 11 and between the two upper bearings 13, 14 of the secondary shaft 12. The endless screw 18 is arranged under the wheel 17 and is located at a level lower than that of the secondary shaft 12. The pinion 11 mounted mobile on the secondary shaft constitutes the clutch system 6.

The reduction ratio of the barring gear assembly 2 is decreased relative to that described in relation to the prior art: a motor 4 turning at 750 rpm (1500 rpm previously). Such a motor turning less quickly reduces the overall reduction ratio corresponding to the reduction ratio of the wheel gear reducer 17 and endless screw 18 and the reduction ratio of the wheel 9 and of the pinion 11.

The endless screw 18 is extended by a shaft 20 coupled to the motor 4 via the hydraulic coupler and the flexible coupling between the hydraulic coupler and the endless screw. The motor is fixed on the bed plate 21 of the box by way of an intermediate piece 37 supporting the motor 4. The endless screw shaft 20 passes through a wall of the box. For this to occur, an opening has been made in the lateral wall 32. This opening extends from the place of the passage of the shaft 20 as far as the parting line 36 of the box 7. The opening is closed by a removable baffle 22, here fixed by screws on the lateral wall 32 of the box 7.

FIG. 3 shows the compactness of the assembly gained from positioning the clutch system 6 on one side of the main wheel 9, between the lateral baffle 32 and said main wheel. The secondary shaft 12 is arranged on the lateral side of the shaft of turbine 1 and parallel to the latter. Such a compactness can be further increased by having the clutch system 6 at a level lower than that of the shaft 1. FIG. 2 shows the relative position of the secondary shaft 12 relative to the axis of turbine A. The secondary shaft 12 is arranged on the lateral side and below the axis of turbine A. The barring gear module 10 is preferably arranged at a level lower than that of the parting line of the box 7. Also, the shaft motor 20 is arranged perpendicularly to the shaft of turbine 1.

Placing the secondary shaft 12 on the side of the wheel 9 gains length and reduces the length of the shaft 20 and minimises problems due to alignment defaults. Also, placing the secondary shaft 12 below the axis of rotation A gains width.

Fixing the barring gear module 10 in the box 7 at a level of elevation lower than that of the axis of rotation A of the shaft gives stability to the installation which then dispenses with long non-rigid support feet and likely to vibrate. Also, aligning all the components located on the endless screw shaft 20 (motor 4, hydraulic coupler 24, endless screw 18) is more stable since the motor is fixed on a more rigid support.

The endless screw 18 is extended by the shaft 20 which projects outside the box 7. The shaft 20 is located at a level lower than that of the secondary shaft 12. The axis of rotation common to the shaft 20 and to the endless screw 18 is horizontal.

The end of the shaft 20 is coupled to the motor 4 via a hydraulic coupler 24 and a flexible coupling 25, both arranged outside the box 7 to minimise oil projections and oil vapour inside the box. The flexible coupling 25 tolerates slight alignment default between the motor 4 and the shaft 20. The hydraulic coupler 24 starts up gently with transmitted torque progressively increasing. The coupler 24 also attenuates any possible vibrations in rotation. It also protects the motor in the event of blockage of the shaft 1 caused by excess friction. The shaft 20 passes through the box via the baffle 22. This baffle is disassemblable by way of screws which aids in installing and removing the barring gear module 10 in the form of the unitary sub-assembly illustrated in FIG. 4. It is evident that the secondary shaft 12 is on the side of the shaft, with the shaft 20 inside the box 7 being shorter. The consequences of poor alignment are thus reduced.

It is evident that the base piece 15 of the barring gear module 10 has on a lower face 27 four support surfaces S1, S2, S3, S4 which are posed on four receiving surfaces R1, R2, R3, R4 substantially horizontal in the box 7. Such an arrangement enables easy installation or disassembling of the barring gear module 10. The barring gear module 10 is put in place in the box 7 in the following order:

- first, the barring gear module 10 is placed above its placement in the box,
- the barring gear module 10 is lowered, during which the screw shaft 20 descends into the opening of the box,
- the piece of base 15 of the barring gear module 10 is placed on the receiving surfaces R1, R2, R3, R4 of the box 7,
- the barring gear module 10 is slid towards the shaft 1 and the relative position of the two shafts 1, 20 is adjusted to give correct alignment between the cogs of the pinion 11 and main wheel 9,
- the barring gear module 10 is fixed on the receiving surfaces R1, R2, R3, R4 of the box 7 for example by blocking screws,
- the baffle 22 which has an orifice is threaded onto the shaft motor 20, then is fixed on the box 7,
- the motor 4 is fixed on the bed plate 21 and the motor is coupled to the screw shaft 20 via the hydraulic coupler 24 and the flexible coupling.

Disassembling is carried out in reverse. The surfaces in contact between the barring gear module and the box could be made in the form of skids, slides or the equivalent to improve precision of displacement of the barring gear module 10 during adjusting. The support surfaces 51, S2, S3, S4 are advantageously arranged horizontally to make the barring gear module 10 slide better during adjusting. The intermediate piece 15 has the support surfaces S1, S2, S3, S4 coming into contact with the receiving surfaces R1, R2, R3, R4. The support surfaces are located near the upper bearings 13, 14 of the secondary shaft 12. The support piece 15 has a rectangular shape and the support surfaces S1, S2, S3, S4 are made on a lower face 27 at the four corners of the rectangle. The support piece 15 is advantageously made in the form of a plate. Such an arrangement makes both installation and adjustment easier. During adjustment, adjustment shims could be intercalated in between the support surfaces 51, S2, S3, S4 of the support plate 15 and the receiving surfaces of the box R1, R2, R3, R4. These shims align the dentures of the pinion 11 and of the main wheel 9 by acting on the vertical position of the barring gear module 10.

Figure 4:
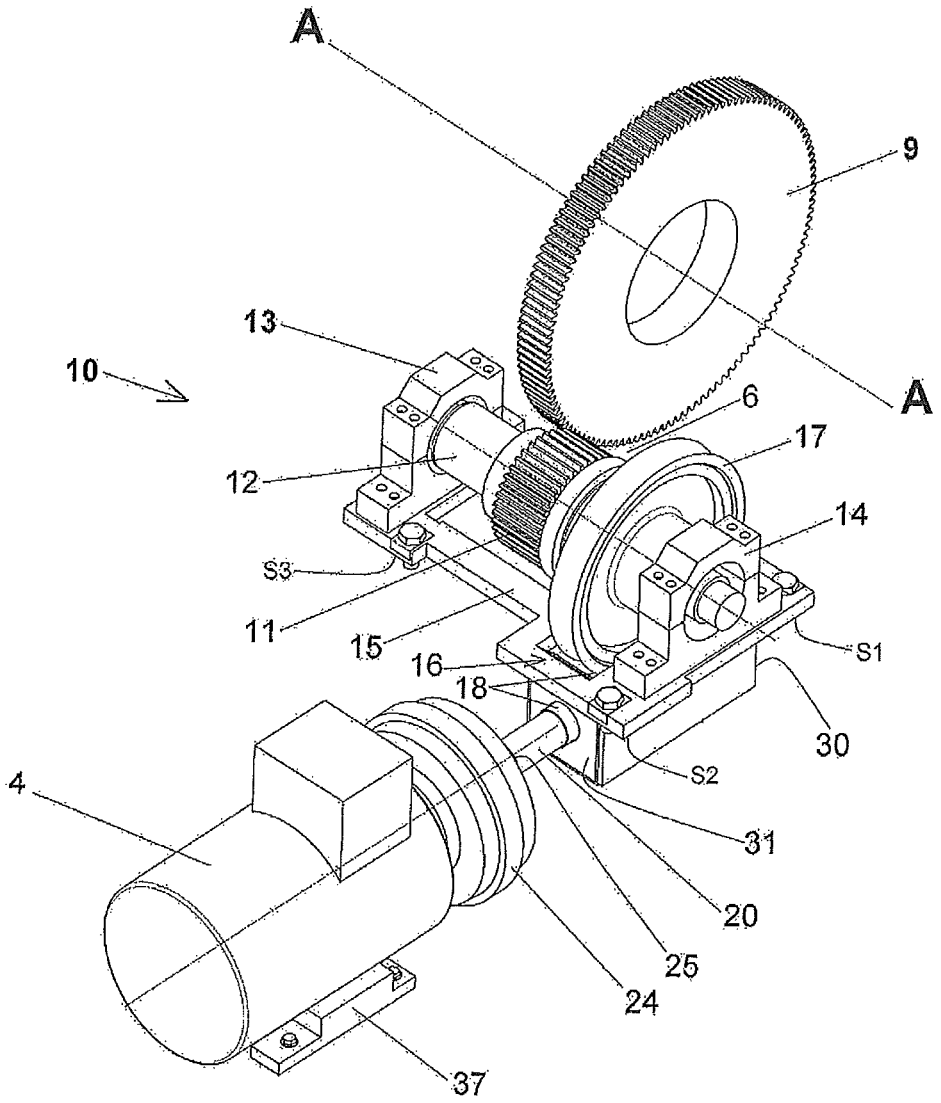
FIG. 4 illustrates in perspective the barring gear module according to the invention.

FIG. 4 shows the barring gear module 10, the wheel 9 being shown only to illustrate the position of the module 10 relative to the axis of rotation A. The barring gear module 10 is made in the form of a pre-assembled module made in a single piece. For this, the support piece 15 which bears the different constituents is used. It is evident that the support piece is in the form of a plate which bears at both ends the two upper bearings 13, 14 receiving the secondary shaft 12 in rotation. The secondary shaft bears between the bearings 13, 14 on one side the secondary wheel 17 mounted fixed on this shaft and on the other side the pinion 11 mounted mobile in translation on the secondary shaft 12. The pinion 11 could be shifted by any appropriate device. The support piece 15 also receives on a lower face two lower bearings 30, 31 supporting in rotation the endless screw 18 which is extended by the shaft 20. The endless screw 18 is arranged between the lower bearings 30, 31. Making the barring gear module 10 in the form of a pre-assembled module effects adjustment of the components making it up (clutch, positioning of bearings 13, 14, 30, 31, adjustment of the gear reducer 16) as well as proper operation tests in the workshop and off the energy production line. Because of this, the installation procedure of the barring gear module 10 in the box 7 is considerably simplified since it remains only to adjust positioning of the pinion 11 relative to the main wheel 9 and couple the motor 4, the other adjustments having already been done. In summary, during installation, the 2 main adjustments to be carried out are:

- alignment of the dentures between pinion 11 and wheel 9 by means of adjustable shims positioned under the plate 15,
- alignment of the motor 4 with the axis of the endless screw 18.

The invention claimed is:

1. A barring gear assembly for a turbo-alternator group and configured to drive, in rotation, a shaft having an axis of rotation A, the barring gear assembly comprising:

- a main wheel fixed on the shaft and defining lateral sides located on either side of the axis of rotation A; and
- a barring gear module having a support piece on which is mounted a clutch system for coupling and uncoupling a secondary shaft to and from the main wheel, the secondary shaft being driven by an auxiliary motor, the barring gear module being positioned on one of the lateral sides of the axis of rotation A,
- wherein the clutch system is mounted on the secondary shaft for rotation on the support piece,
- wherein the barring gear module includes a gear reducer for driving the secondary shaft,
- wherein the gear reducer is a wheel gear reducer and an endless screw, and the wheel gear reducer shares a same rotational axis with a pinion of the clutch system, and
- wherein the wheel gear reducer is positioned at a side of the pinion of the clutch system on the secondary shaft.

2. The barring gear assembly as claimed in claim 1, wherein the clutch system is arranged on a different horizontal plane than that of the axis of rotation A of the shaft.

3. The barring gear assembly as claimed in claim 1, wherein the pinion of the clutch system is mounted displaceable along the secondary shaft, the displacement of the pinion enabling coupling and uncoupling of the auxiliary motor to and from the main wheel via the secondary shaft.

4. The barring gear assembly as claimed in claim 1, wherein the barring gear module is mounted at a box and the endless screw is extended by a shaft passing through the box.

5. The barring gear assembly as claimed in claim 4, wherein the shaft passing through the box passes through the box via a removable baffle.

6. The barring gear assembly as claimed in claim 4, wherein the shaft passing through the box has an end located outside the box, the end being coupled to the auxiliary motor via a hydraulic coupler and a flexible coupling.

7. The barring gear assembly as claimed in claim 5, wherein the shaft passing through the box has an end located outside the box, the end being coupled to the auxiliary motor via a hydraulic coupler and a flexible coupling.

8. The barring gear assembly as claimed in claim 1, wherein the pinion of the clutch system is connected in rotation to the secondary shaft.

9. The barring gear assembly as claimed in claim 1, wherein the endless screw is arranged under the wheel gear reducer and is located at a different horizontal plane than that of the secondary shaft.

10. A turbo-alternator group for producing electricity, comprising:

at least one turbine module and a shaft having the axis of rotation A, the shaft being arranged to be driven by the barring gear assembly as claimed in claim 1.

11. A turbo-alternator group for producing electricity, comprising:

at least one turbine module and a shaft having the axis of rotation A, the shaft being arranged to be driven by the barring gear assembly as claimed in claim 2.

12. A turbo-alternator group for producing electricity, comprising:

at least one turbine module and a shaft having the axis of rotation A, the shaft being arranged to be driven by the barring gear assembly as claimed in claim 3.

13. A turbo-alternator group for producing electricity, comprising:

at least one turbine module and a shaft having the axis of rotation A, the shaft being arranged to be driven by the barring gear assembly as claimed in claim 4.

14. A turbo-alternator group for producing electricity, comprising:

at least one turbine module and a shaft having the axis of rotation A, the shaft being arranged to be driven by the barring gear assembly as claimed in claim 5.

* * * * *